US006445129B1

(12) United States Patent
Seiler et al.

(10) Patent No.: US 6,445,129 B1
(45) Date of Patent: Sep. 3, 2002

(54) GAS DISCHARGE LAMP, IN PARTICULAR FOR MOTOR-VEHICLE HEADLIGHTS

(75) Inventors: Hartmut Seiler, Baden-Baden; Thomas Wizemann, Ludwigsburg; Ingo Gorille, Oberriexingen; Wolfgang Pfaff, Remseck-Aldingen; Wolfgang Schuetze, Vaihingen/Enz; Bernd Mueller, Reutlingen; Robert Kern, Sasbachwalden, all of (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/142,954

(22) PCT Filed: Mar. 6, 1997

(86) PCT No.: PCT/DE97/00423

§ 371 (c)(1),
(2), (4) Date: Mar. 4, 1999

(87) PCT Pub. No.: WO97/35335

PCT Pub. Date: Sep. 25, 1997

(30) Foreign Application Priority Data

Mar. 16, 1996 (DE) ..... 196 10 387

(51) Int. Cl.[7] ..... H01J 17/44; H01J 61/54

(52) U.S. Cl. ..... 313/594; 313/581; 313/595; 313/601; 313/607

(58) Field of Search ..... 313/594, 581, 313/303, 595, 596, 601, 607

(56) References Cited

U.S. PATENT DOCUMENTS

| | | | | | |
|---|---|---|---|---|---|
| 3,993,922 | A | * | 11/1976 | Cosco et al. | 313/594 |
| 4,053,809 | A | * | 10/1977 | Fridrich et al. | 313/594 |
| 4,138,621 | A | * | 2/1979 | Downing et al. | 313/594 |
| 4,360,756 | A | * | 11/1982 | Spencer et al. | 313/553 |
| 4,575,656 | A | * | 3/1986 | Anderson, Jr. et al. | 313/492 |
| 4,899,090 | A | * | 2/1990 | Yoshiike et al. | 315/335 |
| 5,610,477 | A | * | 3/1997 | Ivanov et al. | 313/573 |

FOREIGN PATENT DOCUMENTS

DE 35 19 611 12/1986

OTHER PUBLICATIONS

S. T. Henderson et al., "Lamps & Lighting", p. 328 ff.

* cited by examiner

*Primary Examiner*—Vip Patel
*Assistant Examiner*—Kevin Quarterman
(74) *Attorney, Agent, or Firm*—Kenyon & Kenyon

(57) ABSTRACT

A gaseous-discharge lamp, in particular for motor-vehicle headlamps, includes a burner vessel made of glass or the like that contains a gas. Into this burner vessel extend two main electrodes via two gas-tight electrode bushings. Between the end regions of the main electrodes arranged in the burner vessel, an arc gap is formed, along which an electric arc develops during operation. To achieve a smallest possible ignition voltage, an arrangement is provided for producing a creepage spark gap along the inner vessel wall and/or a spark gap that is shorter than the arc gap, serving as an ignition gap that is spatially separated from the arc gap.

18 Claims, 5 Drawing Sheets

GAS DISCHARGE LAMP, IN PARTICULAR FOR MOTOR-VEHICLE HEADLIGHTS

BACKGROUND INFORMATION

The present invention relates to a gaseous-discharge lamp, in particular for motor-vehicle headlamps.

Gaseous-discharge lamps or high-pressure discharge lamps are already a standard feature of motor-vehicle headlamps today, since they are much more efficient in terms of luminosity than conventional incandescent lamps, and because the spectral composition of their light is very similar to that of daylight. Depending on the ignition method used, these gaseous-discharge lamps require an ignition voltage between the electrodes of from 6 kV up to about 25 kV. This voltage initiates ionization in the gas filling. Small voltages of only about 50 V are still needed for the light to stay alight, i.e., to maintain the electric arc between the electrodes, since sufficient charge carriers are already present. However, producing high ignition voltages, particularly when working with HF-resonance voltage, places high demands on the electronic components being used and on the insulation of the lamp base, the lamp holder, and on the components that produce the high voltage (ignition inductor, ignition capacitor, etc.). Gaseous-discharge lamps of this kind, their use for motor-vehicle headlamps, and variants of ballast units for producing the ignition and maintaining voltage for such lamps are known, for example, from the German Published Patent Application No. 35 19 611 and from "Lamps and Lighting", second edition, S. T. Henderson and A. M. Marsden, p. 328 ff. Due to the problems caused by the high ignition voltage, one has generally striven to reduce the ignition voltage, while at the same time ensuring that a reliable ignition is maintained.

SUMMARY OF THE INVENTION

An advantage of the gaseous-discharge lamp of the present invention is that the ignition voltage is able to be substantially reduced, while a reliable ignition performance is maintained, with only relatively slight changes in the design of the lamp or of its electrodes being necessary. The resultant reduction in the requirements placed on the components contributes significantly to lowering costs when it comes to the electronic ballast unit and, also, when it comes to the gaseous-discharge lamp itself, since in this case, for example, the demands placed on the high voltage strength of the lamp base and of the components arranged therein are considerably diminished. The costs of the gaseous-discharge lamp are clearly reduced by integrating the ballast unit in the lamp base.

The ignition voltage can be lowered quite effectively by using at least one ignition electrode which can be configured separately from the main electrodes or integrally formed thereon.

According to another embodiment of the present invention, this ignition electrode can be designed as a separate third electrode having its own gas-tight electrode bushing traversing the burner vessel, the shorter ignition gap being formed toward one of the main electrodes.

In another advantageous embodiment, of the present invention the ignition electrode can be configured as a separate third electrode on the outside of the burner vessel and form, in turn, the ignition gap toward one of the main electrodes. This design requires only a very slight structural change to the conventional gaseous-discharge lamps; i.e., a later installation of this ignition electrode on conventional gaseous-discharge lamps is also possible, in particular on one of the tubular extensions which contain the electrode bushing for the main electrodes of the lamp. It is useful, in this context, for the ignition electrode to embrace one of the two main electrodes in an annular or semi-annular shape. If the tubular extension of the burner vessel has a constricted area, it is advantageous that the ignition electrode be advantageously arranged at this constricted area or extend into it, since this renders possible an especially short ignition gap and a corresponding clear reduction in the ignition voltage.

In all of the afore-mentioned embodiments, the ignition electrode can be designed either as a true third electrode or as a galvanic connection to one of the main electrodes, which enables the ignition section of the ballast unit to be operated completely separately from the remaining electronics. This means that only the ignition section of the ballast unit needs to be high-voltage proof, not, however, the majority of the components required for normal low-resistance operation. It is certainly possible, as well, for the ignition electrode to be electrically connected to the main electrode that does not play a role in forming the ignition gap, thus simplifying, altogether, the design and the voltage leads.

In another advantageous embodiment of the present invention, the at least one ignition electrode is configured inside the burner vessel, where it is better protected from external influences and where the connection to one of the main electrodes is able to be established easily and cost-effectively. This specific embodiment can be advantageously implemented by linking the ignition electrode to the one main electrode and having it extend up to one point situated near the other main electrode and underneath it in the operating state. It is useful in this context to design the ignition electrode as a rod- or wire-type side arm of the one main electrode, so that the ignition electrode can be manufactured together with the main electrode as a one-piece component, the unattached end of the ignition electrode leading, in particular, to the inner wall of the burner vessel, or, however, for the ignition electrode to be designed as a metallic coating on the inside of the burner vessel and, to facilitate connection to the one main electrode, to extend up to its electrode bushing, to automatically establish an electric connection. A metallization or metal-vapor deposition is to be carried out in this manner relatively inexpensively during the course of normal manufacturing of the lamp.

Starting from the electrode bushing, the metallic coating wraps at least partially around the main electrode and preferably extends for the most part up to the unattached end region of this main electrode, so that a creepage spark gap can form from there. A clearer reduction in the ignition voltage can be achieved by using a lamellar (i.e., strip-shaped element) or light-reflector type metallic coating that extends at least along the region of the arc gap up into the region of the other main electrode. The light-reflector type metallic coating preferably extends essentially over that half of the burner vessel's combustion chamber which is the lower half in the working position and has the additional advantage of helping to assume the function of the screen that is otherwise required in a motor-vehicle headlamp for a lower beam, to adjust the mandatory light/dark cutoff and to protect oncoming traffic from glare. Given reflecting properties, the largest portion of the light that is otherwise lost is able to be used to illuminate the street, provided that the intended use is in a motor-vehicle headlamp.

In another advantageous embodiment, of the present invention each of the two main electrodes is linked to an ignition electrode, and formed between these as an ignition gap is a spark gap or creepage spark gap.

In this context, the ignition electrodes are designed in a first structural embodiment of the present invention as side arms of the main electrodes and extend up to the inner glass wall of the burner vessel, in particular to form a creepage spark gap. The ignition electrodes are configured here as rod- or wire-type arms or as pointed side shapes on the main electrodes, an especially high electric field being produced at the pointed ends, enabling a marked reduction in the ignition voltage. In the case of the rod- or wire-type arms, the ignition electrodes preferably extend obliquely toward one another up to the ignition gap and, in operation, are arranged underneath the main electrodes. This facilitates very short ignition gaps accompanied by a corresponding perceptible reduction in ignition voltage. Due to the thermal conditions in the combustion chamber, the electric arc formed following the ignition spark then travels automatically to the location between the main electrodes.

In an alternative structural embodiment, of the present invention the two ignition electrodes are conceived as metallic coatings, which extend up to the electrode bushings of the main electrodes to establish a connection with these electrodes. Here, as well, designs equivalent to those used for a single electrode formed by metallization are possible, the already described advantages also arising, in turn. When working with two ignition electrodes of this kind, even greater structural variations are possible, and creepage spark gaps can be simply formed as ignition gaps along the inner wall of the burner vessel.

Suitable, in particular, as a metallic coating is a tungsten metallic coating.

Another advantageous embodiments of the present invention lies in forming the main electrodes with a cross-sectional profile having an acute comer, in particular a triangular profile. Since the electrodes extend up to the inner glass wall at the electrode bushing, there is a very sudden rise in dielectricity at the glass/electrode separation point, resulting in high field strengths. This effect is reinforced by the acute corner, so that even in response to relatively low ignition voltages, a creeping discharge is produced at the glass wall. Here, in turn, as in the other exemplary embodiments, of the present invention the electric arc migrates upwards due to thermal effects and, eventually burns across the expanded cross-sectional area. This can also be reinforced in that the mutually facing surfaces of the main electrodes are inclined in opposition with respect to their longitudinal axes, the regions of the main electrodes that are closer to one another continuing as wider and those regions that are more distant from one another continuing as tapered.

DETAILED DESCRIPTION

Figure 1:
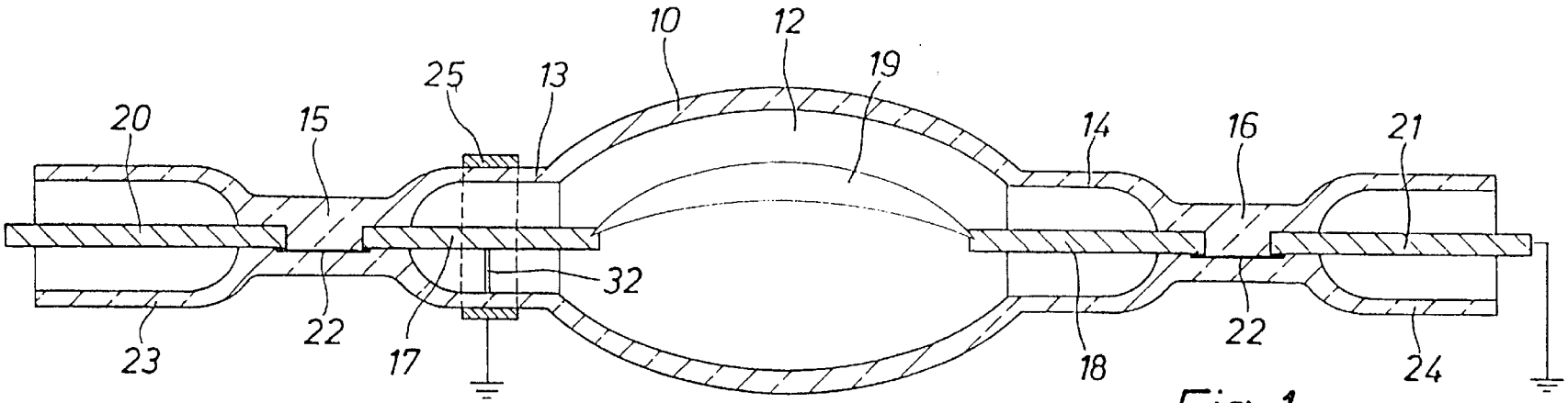
FIG. 1 shows a cross-sectional representation of a first exemplary embodiment of the present invention having an outer annular-wall-shaped ignition electrode.

The gaseous-discharge lamp or high-pressure gaseous-discharge lamp depicted as a first exemplary embodiment of the present invention in FIG. 1 essentially includes a burner vessel 10, which is made of glass or of another transparent, temperature-resistant material, and which has a central combustion chamber 12 with a flattened spherical or ellipsoidal shape that includes two tubular extensions 13, 14 on opposite sides. The outer end regions of these tubular extensions 13, 14 are designed as gas-tight electrode bushings 15, 16 for two rod-shaped main electrodes 17, 18, which extend from both sides slightly into combustion chamber 12. Arc 19 is formed between these two main electrodes 17, 18 during operation.

External electrical attachment leads 20, 21 are linked to the two main electrodes 17, 18 via connecting elements 22, which can be produced from molybdenum foils. Electrical attachment leads 20, 21 continue for a certain distance in tubular elongations 23, 24 of extensions 13, 14, electrode bushings 15, 16 between extensions 13, 14 and tubular elongations 23, 24 containing connecting elements 22 and the connecting ends of main electrodes 17, 18, i.e., attachment leads 20, 21. During manufacturing, main electrodes 17, 18 which are linked to electrical attachment leads 20, 21 are inserted into lateral connection tubes of combustion chamber 12, these connection tubes being fused in the interconnecting region in a way that seals in the interconnecting regions, and forms extensions 13, 14, on the one hand, and tubular elongations 23, 24, on the other hand, on both sides of electrode bushings 15, 16. The following exemplary embodiments of the present invention do not include descriptions of electrical attachment leads 20, 21, of connecting elements 22, nor of tubular elongations 23, 24, it likewise being possible, in principle, of course, for such a simpler version to be implemented. In addition, for the sake of simplicity, all the exemplary embodiments have not included a description of a lamp base, it being possible, for example, for one of the extensions 13, 14 to be embedded in such a lamp base. The second main electrode guided by this lamp base is led back via an external line to the lamp base. Other known designs of burner vessels are, of course, likewise conceivable.

Located upon extension 13 configured to the left of combustion chamber 12 is an annular metal band, which forms an ignition electrode 25. As a result, this ignition electrode 25 wraps concentrically around main electrode 17. A band-shaped metallic coating can also be used in place of a metal band, instead of the annular shape, a partial annular shape likewise being possible.

Ignition electrode 25 is electrically connected outside of burner vessel 10 to right main electrode 18, while main electrode 17 surrounded concentrically by ignition electrode 25 is linked to another voltage terminal of a ballast unit (not shown) for generating and maintaining an ignition voltage. Since the distance between ignition electrode 25 and main electrode 17 is much smaller than the distance between the two main electrodes 17, 18, a much smaller ignition voltage suffices for the ignition. Thus, the ignition voltage can be reduced from 18 kV to 4 kV, for example. Once an ignition spark or ignition arc is formed, the thermal conditions in the combustion chamber cause the ignition arc to migrate toward the arc gap between the main electrodes, so that electric arc 19 is formed, which exhibits an upward curvature of the electric arc, since the hot gas moves upwards against gravity due to its lower density in the arc.

It is, of course, also possible to design ignition electrode 25 as a true third electrode without any galvanic connection to one of the two main electrodes 17, 18. The ignition voltage can then be generated in a separate ignition section of the circuitry, separately from the remaining electronics, the result being that only this ignition section needs to be high-voltage proof, and not, most of the other components required for the low-resistance burning operation to produce the maintaining voltage.

Figure 2:
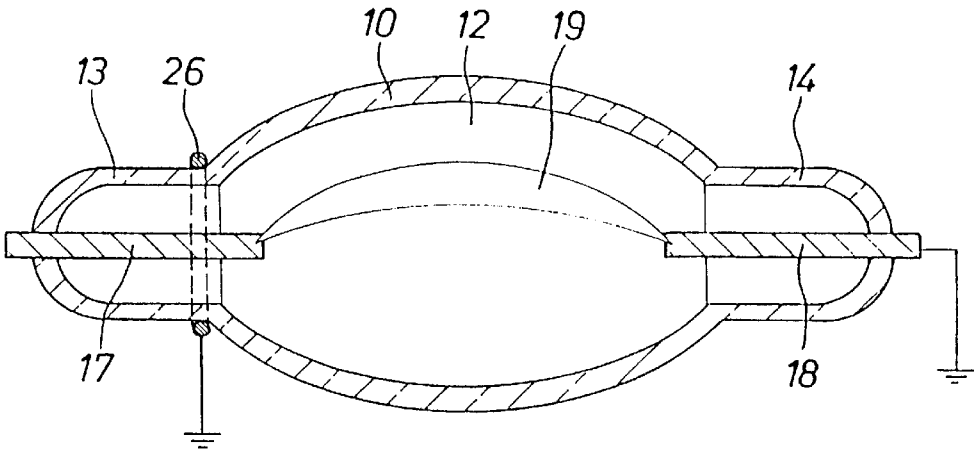
FIG. 2 shows a cross-sectional representation of a second exemplary embodiment of the present invention having a wire-ring-shaped outer ignition electrode.

The second exemplary embodiment of the present invention depicted in FIG. 2 largely corresponds to the first exemplary embodiment of the present invention. In place of band-shaped ignition electrode 25, an ignition electrode 26 configured as a wire ring being used, this wire ring is arranged at the point of connection between left extension 13 and combustion chamber 12.

Figure 3:
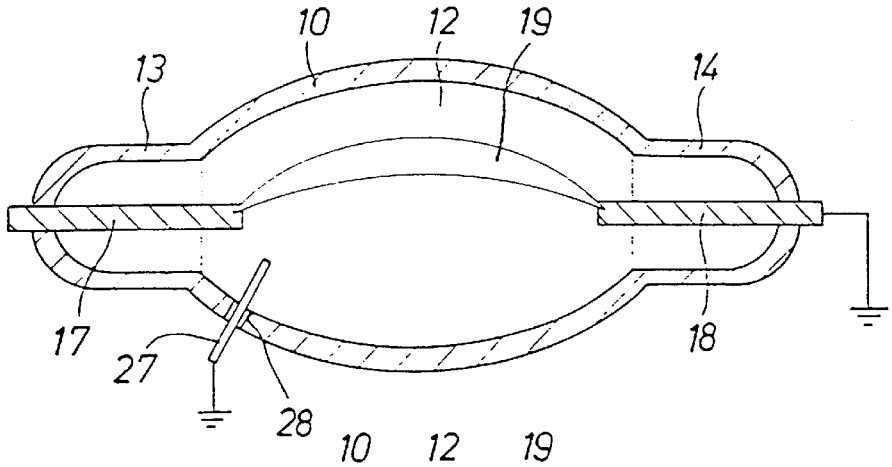
FIG. 3 shows a cross-sectional representation of a third exemplary embodiment of the present invention having a separate ignition electrode passed through the burner vessel.

In the third exemplary embodiment of the present invention illustrated in FIG. 3, a rod- or wire-shaped ignition electrode 27 is passed via a gas-tight electrode bushing 28 through the inner wall of combustion chamber 12. The unattached end of this ignition electrode 27 ends in the vicinity of left main electrode 17, making it possible for a relatively short ignition gap to be formed. As for the rest, the previous explanations apply.

Figure 4:
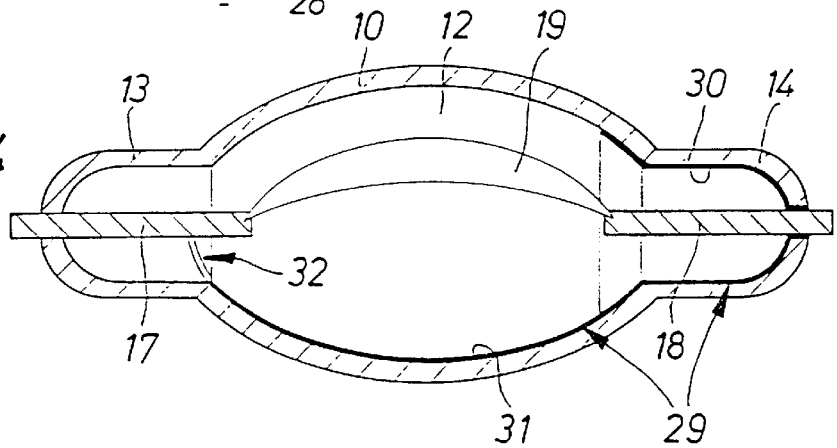
FIG. 4 shows a cross-sectional representation of a fourth exemplary embodiment of the present invention having an inner ignition electrode formed by a metallic coating.

In the fourth exemplary embodiment of the present invention depicted in FIG. 4, an ignition electrode 29 is arranged in the form of a metallic coating or metal-vapor deposition on the inner surface of burner vessel 10. This metallic coating extends over the inner surface of right extension 14 and also projects as an all-around metallic coating 30 somewhat into combustion chamber 12, essentially up to the end region of main electrode 18. Extending out longitudinally from this all-around metallic coating 30 along combustion chamber 12 is a narrow metallization web 31, which essentially reaches up to the starting point of left extension 13, thus up to the vicinity of left main electrode 17.

Therefore, in response to a switch-on, an ignition arc 32 is initially formed between the end of metallization web 31 and left main electrode 17, and then expands, for the thermal reasons mentioned, to electric arc 19 between the two main electrodes 17, 18.

Figure 16:
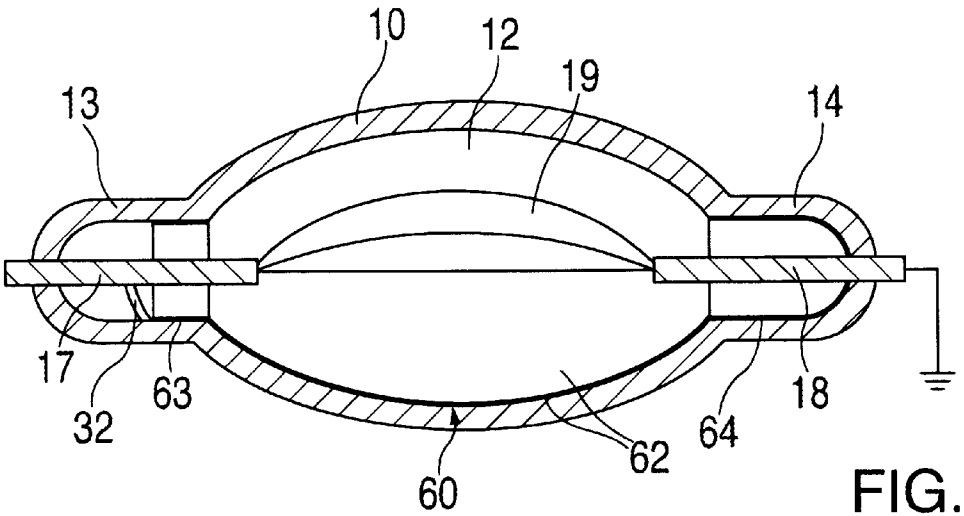
FIG. 16 shows a cross-sectional representation of a fourteenth exemplary embodiment of the present invention having an inner ignition electrode which is formed by a metallic coating and is used, at the same time, as a light reflector.

FIGS. 16 shows a slight variation of the exemplary embodiment of the present invention depicted in FIG. 4. Ignition electrode 29 is replaced by an ignition electrode 60, likewise in the form of an inner metallic coating or inner metal-vapor deposition, where, starting from an all-around metallic coating 61, which corresponds essentially to all-around metallic coating 30, in place of a narrow metallization web 31, a wide, reflector-type metallic coating 62 now extends up to left main electrode 17, and leads there to a metallization ring 63 that embraces this left main electrode 17. Reflector-type metallic coating 62 extends over that half of combustion chamber 12 that is the lower half in the depicted working position, thus up to the level of main electrodes 17, 18. Of course, narrower designs are also conceivable.

In motor-vehicle headlamps, in particular, the light that is emitted downwards is not usable, and needs to be shielded by a screen. This enables one to adjust the mandatory light/dark cutoff to protect oncoming traffic from glare. In the exemplary embodiment of the present invention illustrated in FIG. 16, the need is eliminated for such an additional screen, and its function is assumed by metallic coating 62. If one selects a metallic coating having the right reflecting properties, most of the light that is otherwise lost is able to be used to illuminate the street. In response to a switch-on, similarly to FIG. 4, an ignition arc 32 is initially formed between the left rim of metallization coating ring 63 and left main electrode 17.

Figure 15:
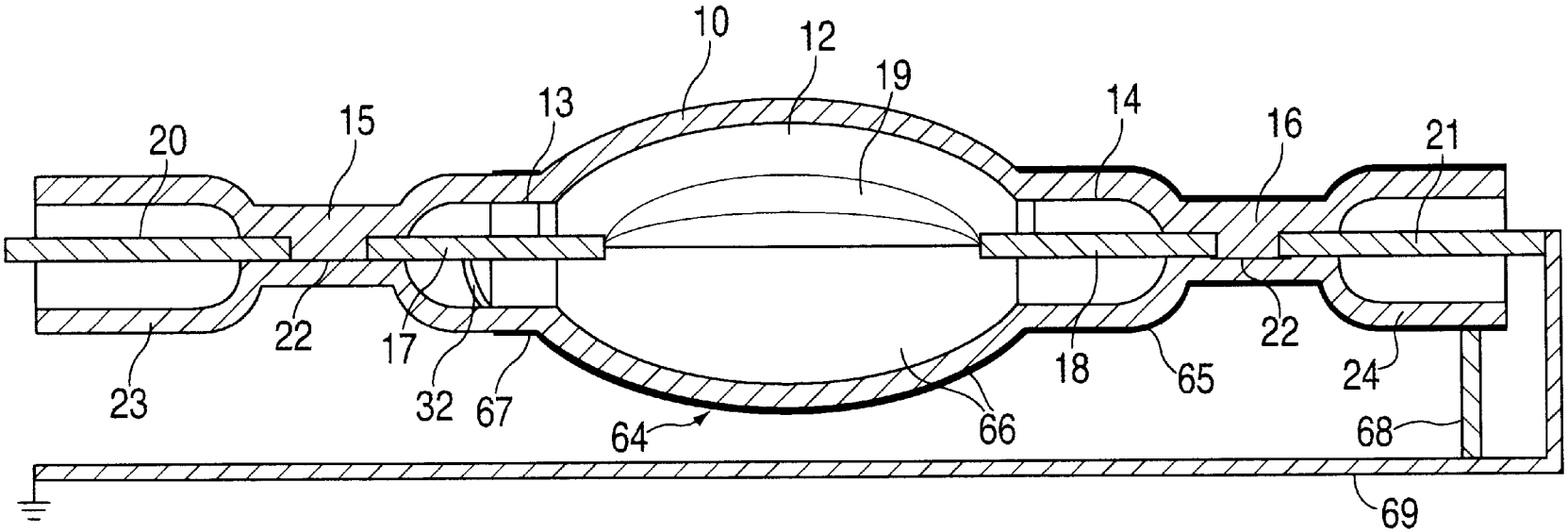
FIG. 15 shows a cross-sectional representation of a thirteenth exemplary embodiment of the present invention having an outer ignition electrode which is formed by a metallic coating and is used, at the same time, as a light reflector.

In principle, it is of no consequence to performance, whether the metallic coating is applied inside burner vessel 10 or to its exterior. FIG. 15 depicts an ignition electrode 64 in the form of an exterior metallic coating or an exterior metal-vapor deposition. Apart from that, all-around metallic coating 65 corresponds to all-around metallic coating 61 of FIG. 16, a reflector-type metallic coating 66 corresponds to reflector-type metallic coating 62, and a metallization ring 67 corresponds to metallization ring 63. In contrast to FIG. 16, all-around metallic coating 65 effected as exterior metallic coating can, of course, not reach main electrode 18. Therefore, it continues along electrode bushing 16 and elongation 24 and is contacted there via a contact wire 68, and is connected via a line 69, on the one hand, to ground and, on the other hand, to electrical attachment lead 21.

Figure 5:
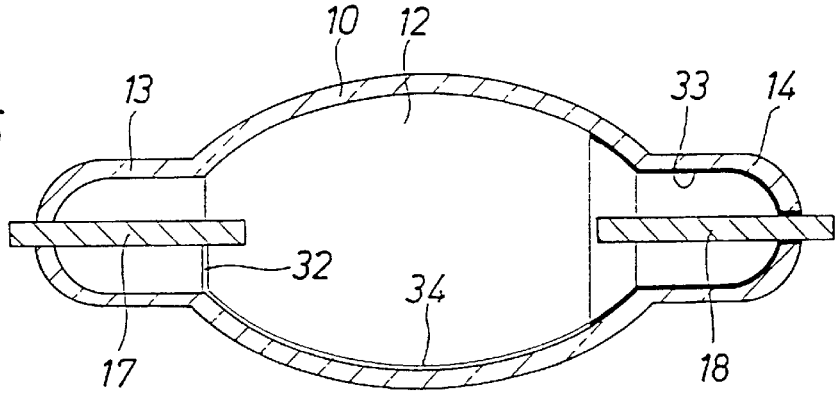
FIG. 5 shows a cross-sectional representation of a fifth exemplary embodiment of the present invention having a differently configured inner electrode formed by a metallic coating.

The fifth exemplary embodiment of the present invention shown in FIG. 5 substantially corresponds to the fourth exemplary embodiment, of the present invention merely metallization web 31 being eliminated, and an ignition electrode 33 merely being formed by an all-around metallic coating, which corresponds to all-around metallic coating 30.

At the transition between the unattached, all-around edge of ignition electrode 33 and the inner glass surface of combustion chamber 12, there is a sudden, pronounced rise in dielectricity. As a result, in response to an applied ignition voltage, very high field strengths occur, this effect still being reinforced by the sharp edge at the end of the metallic coating. This magnified field strength reduces the ignition voltage needed to effect sparkover. The first discharge develops as creeping discharge 34 at the glass well and as a sparkover between the glass wall at the point of connection between combustion chamber 12, extension 15, and main electrode 17.

Figure 6:
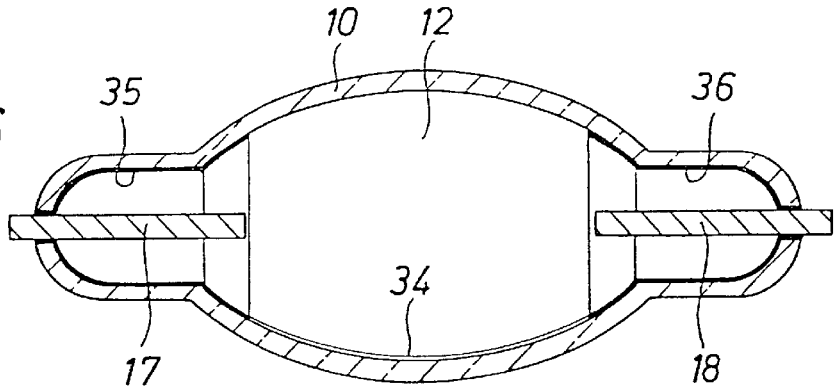
FIG. 6 shows a cross-sectional representation of a sixth exemplary embodiment of the present invention having two inner ignition electrodes formed by a metallic coating.

The sixth exemplary embodiment of the present invention shown in FIG. 6 corresponds substantially to the fifth exemplary embodiment, of the present invention provision being made for ignition electrodes 35, 36 configured on both main electrodes 17, 18 as all-around metallic coatings. Here, as well, a creeping discharge is formed, in turn, in a corresponding manner along the glass wall between ignition electrodes 35, 36.

Slightly altering the exemplary embodiment shown in FIG. 6, provision can also be made for metallization webs (not yet shown) to extend out, as the case may be, from one or both ignition electrodes 35, 36 to the other ignition electrode.

Figure 7:
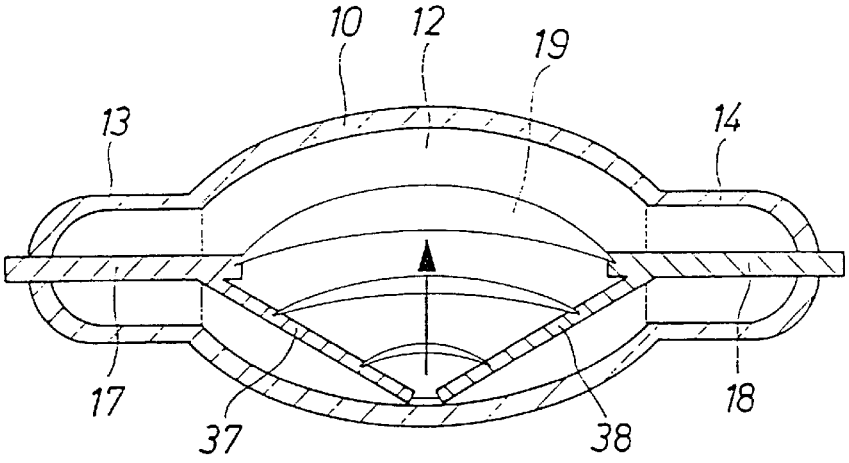
FIG. 7 shows a cross-sectional representation of a seventh exemplary embodiment of the present invention having two ignition electrodes configured as lateral extensions of the main electrodes.

In the seventh exemplary embodiment of the present invention shown in FIG. 7, rod- or wire-type ignition electrodes 37, 38 extend out from main electrodes 17, 18, diagonally down toward the glass wall, and end there at a small distance from one another to form the ignition gap. These ignition electrodes 37, 38, which emanate laterally from main electrodes 17, 18, can either be premolded or welded on in one piece.

Due to the very small distance between ignition electrodes 37, 38, the ignition can be carried out in this case with very little ignition voltage, since the breakdown voltage in gases is roughly proportional to the distance between electrodes. The configuration and formation of the electrode extensions in relation to the inner vessel wall ensures that the electric arc formed following the ignition spark or ignition arc migrates in this case as well, due to the thermal conditions in the combustion chamber, to the location between main electrodes 17, 18, where it would burn even without ignition electrodes 37, 38. Due to the vicinity of the vessel wall, an electric arc burning between ignition electrodes 37, 38 is cooled more vigorously than an electric arc that has a greater clearance to the wall. The electric arc migrates, therefore, to the location of the combustion chamber 12 where it finds the greatest possible distance to the vessel wall and, thus, is subjected to the least possible cooling. The physical reason for the migration of the electric arc into the zone of least possible cooling is that a rise in temperature increases charge carrier production in the arc and at the electrodes, which, in turn, causes the internal resistance of the electric arc to decline. This arc migration is also reinforced by the fact that, due to its lower density, the hot gas in the arc migrates upwards against gravity, ultimately leading to a slight upward curvature of the arc, given a steady-state electric arc 19. These physical circumstances are simple to describe with respect to this exemplary embodiment; however, they apply analogously to the other exemplary embodiments, as well.

Figure 8:
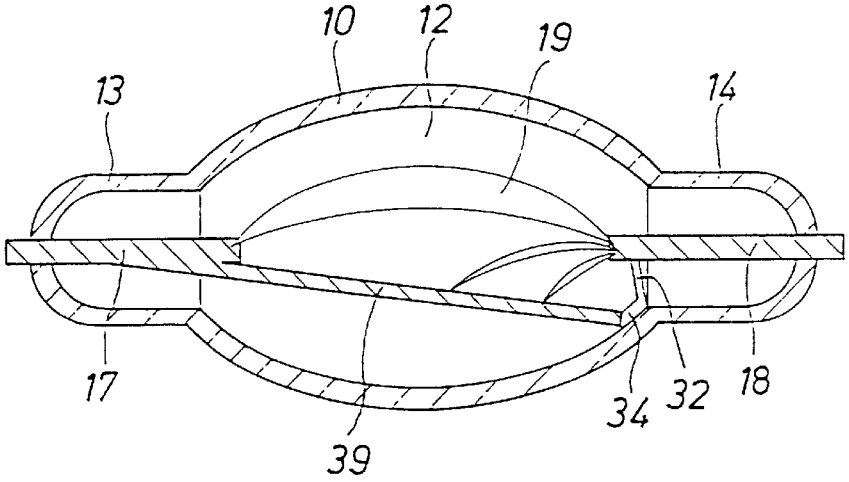
FIG. 8 shows a cross-sectional representation of an eighth exemplary embodiment oft he present invention having an ignition electrode configured as a lateral extension of a main electrode.

In the eighth exemplary embodiment of the present invention shown in FIG. 8, merely left main electrode 17 has an ignition electrode 39, which emanates laterally from this main electrode 17 and extends diagonally down into the region underneath the unattached end of the other main electrode 18 up to the glass wall. Here, as well, initially forming between the unattached end of ignition electrode 39 and right main electrode 18 is an ignition spark, which, due to the contact at the glass wall, can develop in part as a creepage spark and, in part, as a sparkover spark, this ignition spark or ignition arc then migrating upwards, in turn, and becoming electric arc 19 between main electrodes 17, 18, as shown schematically in FIG. 8.

Figure 9:
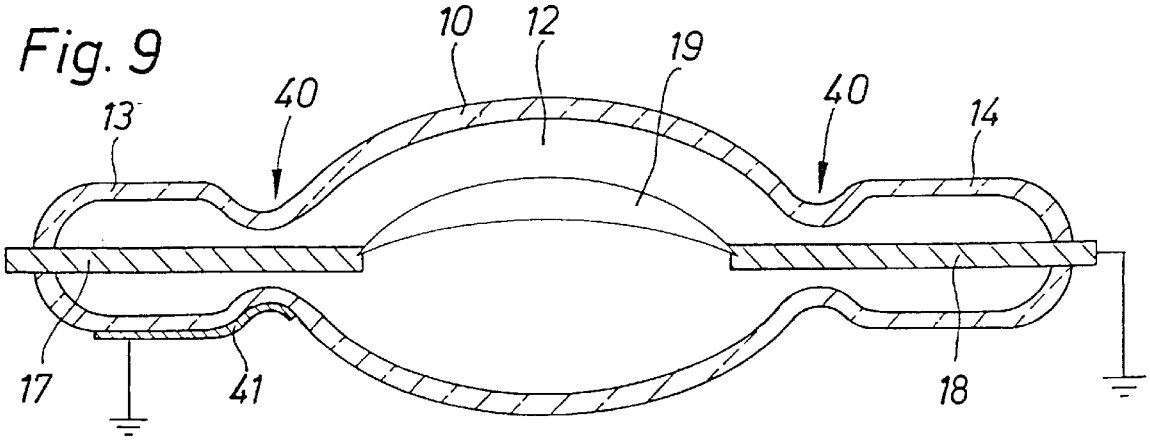
FIG. 9 shows a cross-sectional representation of a ninth exemplary embodiment of the present invention having an outer ignition electrode which engages in a constricted region of the burner vessel.

In the ninth exemplary embodiment of the present invention shown in FIG. 9, provision is made between combustion chamber 12 and lateral extensions 13, 14 for a constricted area 40 of the glass wall. An ignition electrode 41 constituted as a metal strip extends along left extension 13 into this constricted area 40, achieving an especially small distance to left main electrode 17 and a corresponding small ignition voltage.

Ignition electrode 41 can be also replaced by other external electrode forms, for example in accordance with the exemplary embodiments depicted in FIGS. 1 and 2, or by metallic coatings, these electrodes extending either into constricted area 40 or being arranged in an annular shape in this area.

Figure 10:
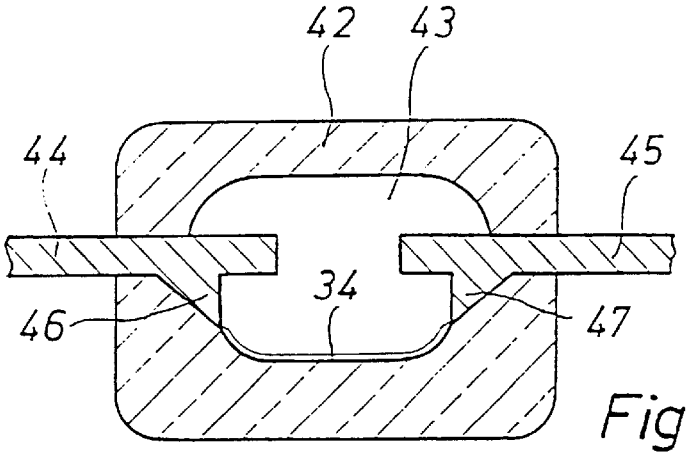
FIG. 10 shows a cross-sectional representation of a tenth exemplary embodiment of the present invention having two ignition electrodes designed as pointed lateral extensions of the main electrodes.

In the case of the tenth exemplary embodiment of the present invention shown in FIG. 10, a simplified burner vessel 42 is shown which does not have lateral extensions 13, 14 and which includes, in turn, a flattened or ellipsoidal combustion chamber 43. Extending into this combustion chamber 43 from two opposite sides are two main electrodes 44, 45 having a round cross-section in accordance with FIG. 11, thus, a rod-shaped form. The electrode bushings running through the walls of burner vessel 42 must, of course, in turn be designed to be gas-tight. In the inlet region of combustion chamber 43, main electrodes 44, 45 have jagged-type, pointed extensions, which extend downwards during operation and which form two ignition electrodes 46, 47. The points of these ignition electrodes 46, 47 run into the inner vessel wall.

Here, as well, creeping discharges 34 are formed, in turn, between the points of ignition electrodes 46, 47 along the vessel wall, on the one hand, due to the geometric configuration, thus in particulary the pointed form of ignition electrodes 46, 47 and, on the other hand, due to the sudden rise in dielectricity that occurs already in response to relatively low voltages. Because of thermal effects, the electric arc initiated as a creeping discharge 34 again migrates upwards and then burns between main electrodes 44, 45.

Figure 11:
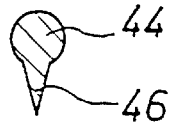
FIG. 11 shows a cross-sectional representation of a main electrode according to the present invention provided with extensions.
Figure 12:
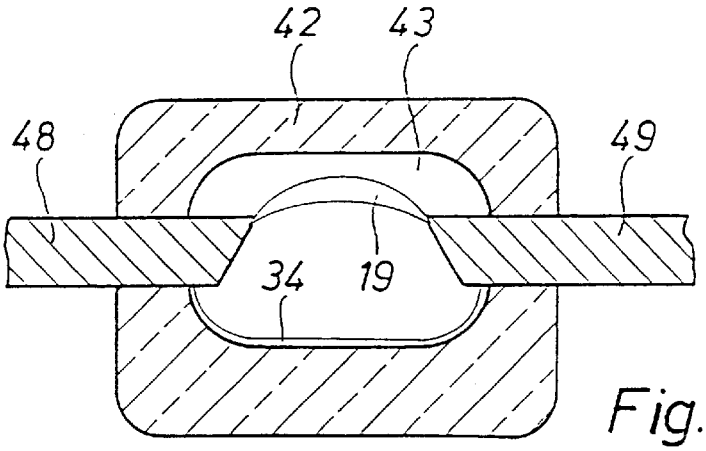
FIG. 12 shows a cross-sectional representation of an eleventh exemplary embodiment of the present invention having two main electrodes showing a tapered profile.
Figure 13:
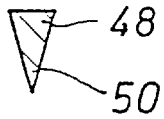
FIG. 13 shows a cross-sectional representation of the profile of one of the main electrodes.
Figure 14:
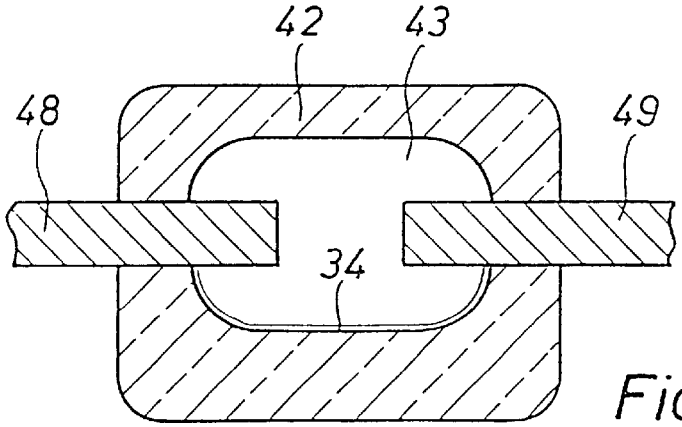
FIG. 14 shows a cross-sectional representation of a twelfth exemplary embodiment of the present invention having an electrode shape that is slightly altered as compared to that of FIG. 12.

The eleventh exemplary embodiment of the present invention shown in FIGS. 12 and 13 corresponds substantially to the tenth exemplary embodiment of the present invention illustrated in FIGS. 10 and 11. Separate ignition electrodes 46, 47 have been eliminated, provision being made instead for correspondingly arranged main electrodes 48, 49 having a triangular or wedge-shaped cross-sectional profile, as shown in FIG. 13. Therefore, main electrodes 48, 49 have a downward-directed pointed edge 50, where a high field strength is produced, in turn, at the junction point between the metal of main electrodes 48, 49 and the material of the vessel wall, forming a creeping discharge 34, in turn, corresponding substantially to that of the tenth exemplary embodiment. Once formed, an electric migrates upwards, in turn, and burns at the upper ends of main electrodes 48, 49, these having a wider form due to the wedge shape. This upward migration is reinforced by the chamfering of the end faces of main electrodes 48, 49. According to the twelth exemplary embodiment of the present invention shown in FIG. 14, however, one can also do without the chamfering of the end faces of main electrodes 48, 49, main electrodes 48, 49 depicted in FIG. 14 likewise having the cross-sectional shape shown in FIG. 13.

Materials suited for the inner metallic coatings are primarily tungsten and the platinum metals. For the exterior metallic coatings, all non-oxidizing metals having a melting point of over about 1000° C. can be used. If metallic coatings applied to the exterior are covered with a temperature-resistant protective layer that is impermeable to oxygen, e.g., with $SiO_2$ or with a ceramic layer, then less precious metals having melting temperature of over 1100° C. can also be used, such as chromium, nickel, molybdenum.

What is claimed is:

1. A gaseous-discharge lamp for use in a motor-vehicle headlamp, comprising:

a burner vessel formed of a glass and containing a gas;

a first gas-tight electrode bushing;

a first main electrode extending into the burner vessel via the first gas-tight electrode bushing;

a second gas-tight electrode bushing;

a second main electrode extending into the burner vessel via the second gas-tight electrode bushing, an arc gap along which an electric arc develops during operation being formed between an end region of the first main electrode and an end region of the second main electrode; and an arrangement for producing, as an ignition gap that is spatially separated from the arc gap, at least one of a creepage spark gap along an inner wall of the burner vessel and a spark gap shorter than the arc gap, the arrangement for producing the creepage spark gap includes at least one ignition electrode, the at least one ignition electrode being arranged inside the burner vessel;

wherein the burner vessel includes:

a combustion chamber, a first tubular extension extending from the combustion chamber along a first direction and containing the first main electrode, the first tubular extension including an end region containing the first gas-tight electrode bushing, and a second tubular extension extending from the combustion chamber along a second direction that is opposite to the first direction and containing the second main electrode, the second tubular extension including an end region containing the second gas-tight electrode bushing, wherein the at least on e ignition electrode is coupled to one of the first main electrode and the second main electrode and extends up to a location situated near and being underneath another one of the first main electrode and the second main electrode in an operating state, and wherein the at least one ignition electrode corresponds to one of a rod-type side arm and a wire-type side arm of one of the first main electrode and the second main electrode.

2. The gaseous-discharge lamp according to claim 1, wherein one end of the at least one ignition electrode extends to a wall of the burner vessel.

3. A gaseous-discharge lamp for use in a motor-vehicle headlamp, comprising:

a burner vessel formed of a glass and containing a gas;

a first gas-tight electrode bushing;

a first main electrode extending into the burner vessel via the first gas-tight electrode bushing;

a second gas-tight electrode bushing;

a second main electrode extending into the burner vessel via the second gas-tight electrode bushing, an arc gap along which an electric arc develops during operation being formed between an end region of the first main electrode and an end region of the second main electrode; and an arrangement for producing, as an ignition gap that is spatially separated from the arc gap, at least one of a creepage spark gap along an inner wall of the burner vessel and a spark gap shorter than the arc gap, the arrangement for producing the creepage spark gap including at least one ignition electrode;

wherein the burner vessel includes:

a combustion chamber, a first tubular extension extending from the combustion chamber along a first direction and containing the first main electrode, the first tubular extension including an end region containing the first gas-tight electrode bushing, and a second tubular extension extending from the combustion chamber along a second direction that is opposite to the first direction and containing the second main electrode, the second tubular extension including an end region containing the second gas-tight electrode bushing, and wherein the at least one ignition electrode includes a metallic coating that extends along an inside surface of the burner vessel to one of the first gas-tight electrode bushing and the second gas-tight electrode bushing in order to form a connection with a corresponding one of the first main electrode and the second main electrode.

4. The gaseous-discharge lamp according to claim 3, wherein the metallic coating includes one of tungsten and a platinum metal.

5. A gaseous-discharge lamp for use in a motor-vehicle headlamp, comprising:

a burner vessel formed of a glass and containing a gas;

a first gas-tight electrode bushing;

a first main electrode extending into the burner vessel via the first gas-tight electrode bushing;

a second gas-tight electrode bushing;

a second main electrode extending into the burner vessel via the second gas-tight electrode bushing, an arc gap along which an electric arc develops during operation being formed between an end region of the first main electrode and an end region of the second main electrode; and an arrangement for producing, as an ignition gap that is spatially separated from the arc gap, at least one of a creepage spark gap along an inner wall of the burner vessel and a spark gap shorter than the arc gap, the arrangement for producing the creepage spark gap includes at least one ignition electrode;

wherein the burner vessel includes:

a combustion chamber, a first tubular extension extending from the combustion chamber along a first direction and containing the first main electrode, the first tubular extension including an end region containing the first gas-tight electrode bushing, and a second tubular extension extending from the combustion chamber along a second direction that is opposite to the first direction and containing the second main electrode, the second tubular extension including an end region containing the second gas-tight electrode bushing, wherein the at least one ignition electrode includes a metallic coating that extends on an outside surface of the burner vessel to a connection contact element in order to form a connection with one of the first main electrode and the second main electrode, and wherein the at least one ignition electrode is arranged at least along an area of the arc gap as one of a lamellar and a light-reflector type metallic coating.

6. The gaseous-discharge lamp according to claim 5, wherein the light-reflector type metallic coating extends over a surface of a half portion of the combustion chamber that serves as a lower half in a working position.

7. The gaseous-discharge lamp according to claim 6, wherein at least one of the lamellar and the light-reflector type metallic coating extends up to a metallization ring having an annular shape that surrounds one of the first main electrode and the second main electrode.

8. A gaseous-discharge lamp for use in a motor-vehicle headlamp, comprising:

a burner vessel formed of a glass and containing a gas;

a first gas-tight electrode bushing;

a first main electrode extending into the burner vessel via the first gas-tight electrode bushing;

a second gas-tight electrode bushing;

a second main electrode extending into the burner vessel via the second gas-tight electrode bushing, an arc gap along which an electric arc develops during operation being formed between an end region of the first main electrode and an end region of the second main electrode; and an arrangement for producing, as an ignition gap that is spatially separated from the arc gap, at least one of a creepage spark gap along an inner wall of the burner vessel and a spark gap shorter than the arc gap, the arrangement for producing the creepage spark gap including at least one ignition electrode, the at least one ignition electrode being arranged inside the burner vessel;

wherein the burner vessel includes:

a combustion chamber, a first tubular extension extending from the combustion chamber along a first direction and containing the first main electrode, the first tubular extension including an end region containing the first gas-tight electrode bushing, and a second tubular extension extending from the combustion chamber along a second direction that is opposite to the first direction and containing the second main electrode, the second tubular extension including an end region containing the second gas-tight electrode bushing;

wherein each one of the first main electrode and the second main electrode is connected to the at least one ignition electrode, and wherein at least one of the spark gap and the creepage spark gap is formed between the at least one ignition electrode and a corresponding one of the first main electrode and the second main electrode.

9. The gaseous-discharge lamp according to claim 8, wherein the at least one ignition electrode includes at least a first ignition electrode and a second ignition electrode, and wherein each one of the first ignition electrode and the second ignition electrode corresponds to a side arm of an associated one of the first main electrode and the second main electrode.

10. The gaseous-discharge lamp according to claim 9, wherein each one of the first ignition electrode and the second ignition electrode extends along an inner wall of the burner vessel in order to form the creepage spark gap.

11. The gaseous-discharge lamp according to claim 10, wherein each one of the first ignition electrode and the second ignition electrode includes one of a rod-type side arm, a wire-type side arm, and a pointed side shape element of a corresponding one of the first main electrode and the second main electrode.

12. The gaseous-discharge lamp according to claim 11, wherein the first ignition electrode and-the second ignition electrode extend obliquely toward one another up to the ignition gap and are arranged underneath a corresponding one of the first main electrode and the second main electrode during an operation of the gas-discharge lamp.

13. The gaseous-discharge lamp according to claim 9, wherein each one of the first ignition electrode and the second ignition electrode includes a metallic coating extending up to a corresponding one of the first gas-tight electrode bushing of the first main electrode and the second gas-tight electrode bushing of the second main electrode to form a connection with a corresponding one of the first main electrode and the second main electrode.

14. The gaseous-discharge lamp according to claim 13, wherein each one of the first ignition electrode and the second ignition electrode extends from a corresponding one of the first gas-tight electrode bushing and the second gas-tight electrode bushing through the burner vessel in order to at least partially surround a corresponding one of the first main electrode and the second main electrode.

15. The gaseous-discharge lamp according to claim 14, wherein each one of the first ignition electrode and the second ignition electrode extends up to an unattached end region of a corresponding one of the first main electrode and the second main electrode.

16. The gaseous-discharge lamp according to claim 13, wherein each one of the metallic coating of the first ignition electrode and the metallic coating of the second ignition electrode extends along an inside surface of the burner vessel and includes one of tungsten and a platinum metal.

17. The gas-discharge lamp according to claim 13, wherein each one of the metallic coating of the first ignition electrode and the metallic coating of the second ignition electrode extends along an outside surface of the burner vessel and includes one of a non-oxidizing metal having a melting point of over about 1000° C. and a less precious metal covered with a protective layer that is impermeable to oxygen and has a melting temperature of over about 1100° C.

18. A gaseous-discharge lamp for use in a motor-vehicle headlamp, comprising:

a burner vessel formed of a glass and containing a gas;

a first gas-tight electrode bushing;

a first main electrode extending into the burner vessel via the first gas-tight electrode bushing;

a second gas-tight electrode bushing;

a second main electrode extending into the burner vessel via the second gas-tight electrode bushing, an arc gap along which an electric arc develops during operation being formed between an end region of the first main electrode and an end region of the second main electrode; and an arrangement for producing, as an ignition gap that is spatially separated from the arc gap, at least one of a creepage spark gap along an inner wall of the burner vessel and a spark gap shorter than the arc gap, the arrangement for producing the creepage spark gap includes at least one ignition electrode;

wherein the burner vessel includes:

a combustion chamber, a first tubular extension extending from the combustion chamber along a first direction and containing the first main electrode, the first tubular extension including an end region containing the first gas-tight electrode bushing, and a second tubular extension extending from the combustion chamber along a second direction that is opposite to the first direction and containing the second main electrode, the second tubular extension including an end region containing the second gas-tight electrode bushing, wherein the at least one ignition electrode includes a metallic coating that extends on an outside surface of the burner vessel to a connection contact element in order to form a connection with one of the first main electrode and the second main electrode, and wherein the metallic coating includes one of a non-oxidizing metal having a melting point of over about 1000° C. and a less precious metal covered with a protective layer that is impermeable to oxygen and has a melting temperature of over about 1100° C.

* * * * *

UNITED STATES PATENT AND TRADEMARK OFFICE

CERTIFICATE OF CORRECTION

PATENT NO. : 6,445,129 B1
DATED : September 3, 2002
INVENTOR(S) : Hartmut Seiler et al.

It is certified that error appears in the above-identified patent and that said Letters Patent is hereby corrected as shown below:

Title page, Item [54], Column 1, line 1,
Change the title from "GAS DISCHARGE LAMP, IN PARTICULAR FOR MOTOR-VEHICLE HEADLIGHTS", to -- GAS DISCHARGE LAMP WITH ADDITIONAL IGNITION ELECTRODE, IN PARTICULAR FOR MOTOR-VEHICLE HEADLIGHTS --.

Column 5,
Line 36, after "chamber," insert -- 12 --.
Line 54, delete "being" and insert -- is --.

Column 7,
Line 9, delete "15" and insert -- 13 --.

Column 8,
Line 40, change "thus in particulary" to -- in particular --.
Line 60, after "electric," insert -- arc --.

Signed and Sealed this

Twenty-third Day of September, 2003

JAMES E. ROGAN
*Director of the United States Patent and Trademark Office*